US006033181A

United States Patent [19]

Endres et al.

[11] Patent Number: 6,033,181

[45] Date of Patent: Mar. 7, 2000

[54] TURBINE BLADE OF A GAS TURBINE

[75] Inventors: Wilhelm Endres, Remetschwil; Hans Wettstein, Fislisbach, both of Switzerland

[73] Assignee: Asea Brown Boveri AG, Baden, Switzerland

[21] Appl. No.: 09/141,586

[22] Filed: Aug. 28, 1998

[30] Foreign Application Priority Data

Sep. 1, 1997 [DE] Germany ..... 197 38 065

[51] Int. Cl.[7] ..... B63H 1/26

[52] U.S. Cl. ..... 416/97 R; 416/96 R; 416/96 A

[58] Field of Search ..... 415/115; 416/96 R, 416/96 A, 97 R

[56] References Cited

U.S. PATENT DOCUMENTS

| | | | |
|---|---|---|---|
| 4,505,639 | 3/1985 | Groess et al. | 416/97 R |
| 4,565,490 | 1/1986 | Rice | 145/114 |
| 5,253,976 | 10/1993 | Cunha | 415/114 |
| 5,320,483 | 6/1994 | Cunha et al. | 415/114 |

FOREIGN PATENT DOCUMENTS

| | | |
|---|---|---|
| 0698723A2 | 2/1996 | European Pat. Off. . |
| 1476905 | 3/1970 | Germany . |
| 3642789C2 | 6/1987 | Germany . |
| 62-294703A | 12/1987 | Japan . |

*Primary Examiner*—Edward K. Look
*Assistant Examiner*—Ninh Nguyen
*Attorney, Agent, or Firm*—Burns, Doane, Swecker & Mathis, L.L.P.

[57] ABSTRACT

According to the invention, turbine blades are provided that have increased functional reliability, which is achieved in that the interior space (8) of the blade body (3) in the region of the suction-side wall (4), the pressure-side wall (5) and the trailing blade edge (7) has a closed steam-cooling system (9) having at least one cooling passage (10, 27, 28). An open cooling system (11) having at least one cooling passage (14, 15) and a plurality of film-cooling holes (22) which pass through the blade body (3) is formed in the region of the leading blade edge (6).

8 Claims, 2 Drawing Sheets

FIG. 1
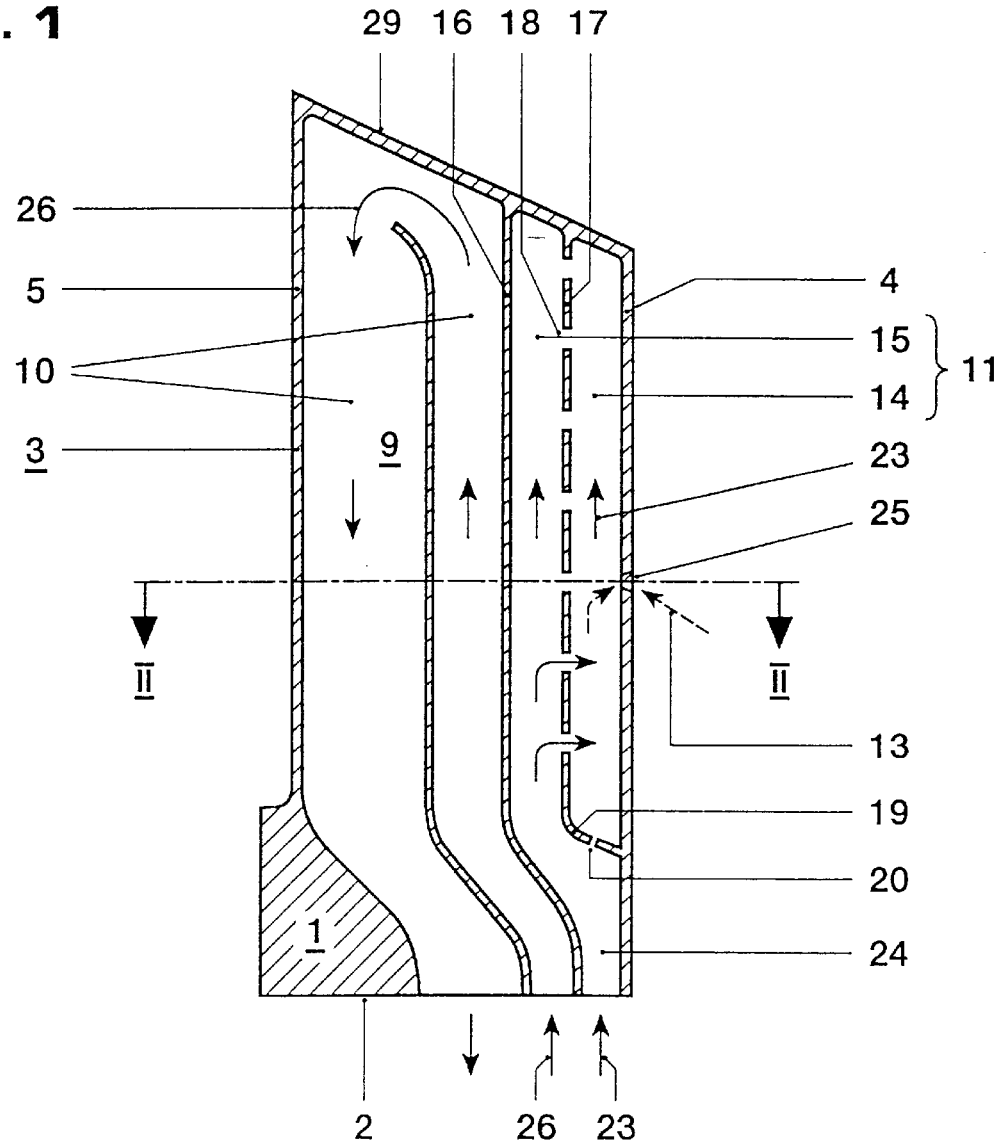
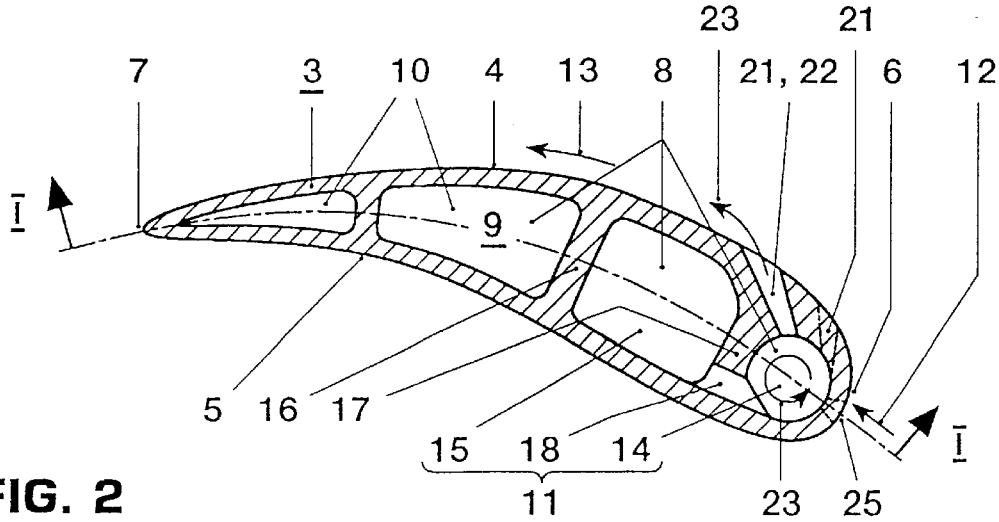
FIG. 2

FIG. 3
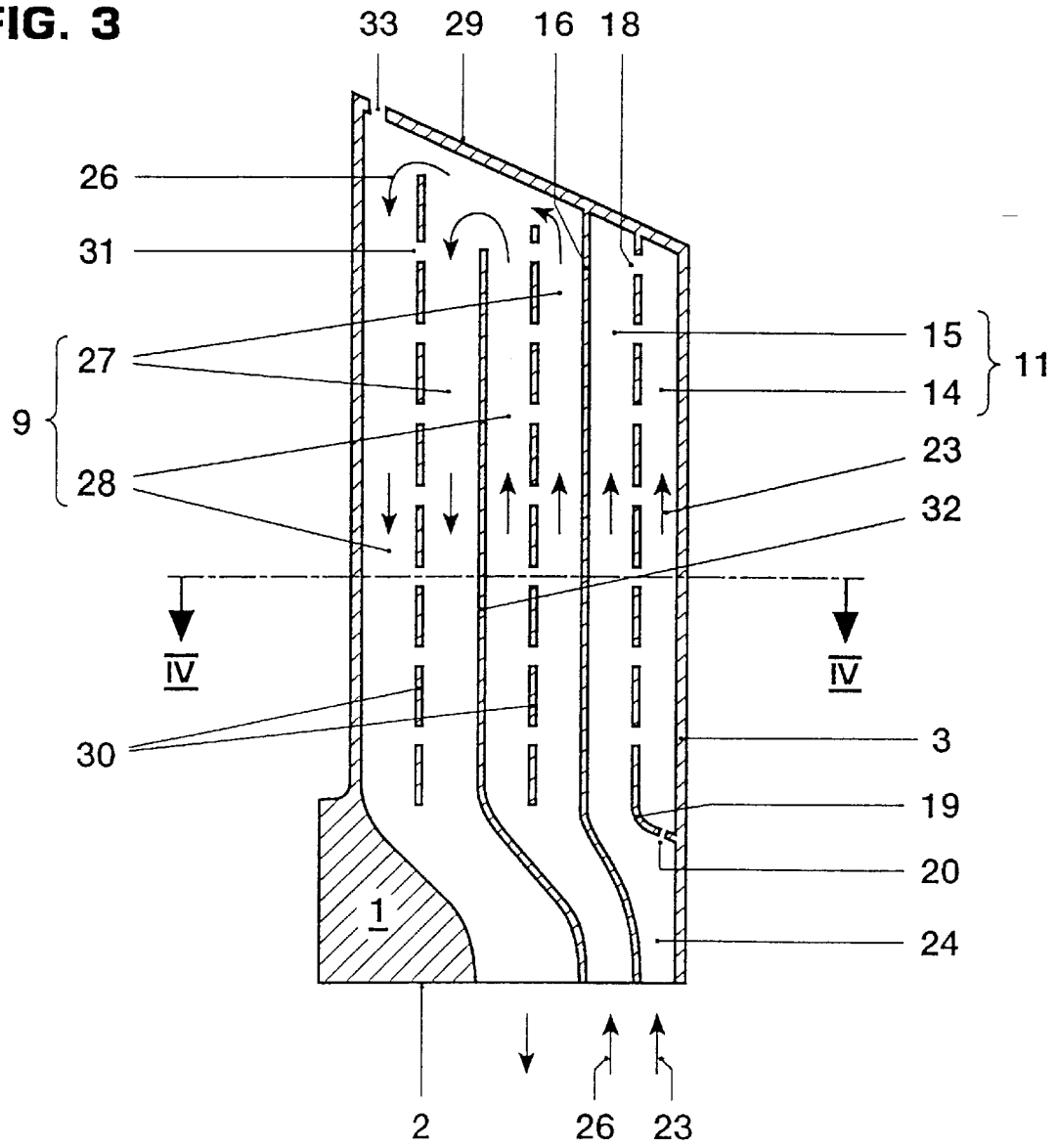
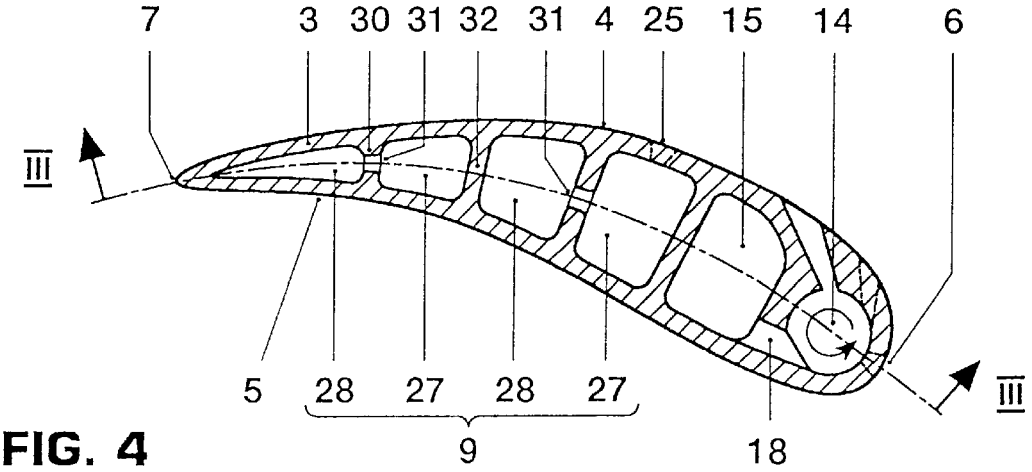
FIG. 4

TURBINE BLADE OF A GAS TURBINE

BACKGROUND OF THE INVENTION

1. Field of the Invention

The invention relates to a turbine blade of a gas turbine according to the preamble of claim 1.

2. Discussion of Background

The increase in output and the improvement in the efficiency of modern gas-turbine plants is achieved not least by an increase in the temperatures. However, since the thermal strength of the material of the gas turbine is limited, the components exposed to the maximum temperatures must be cooled. This also concerns in particular the guide and moving blades of the gas turbine.

To this end, the turbine blades are designed to be at least partly hollow in their interior and have one or more cooling passages. A cooling fluid flows through the latter, the cooling action resulting from convective heat transfer in the interior of the blade body. Additional film cooling is possible by portions of the cooling fluid being directed through openings in the blade body onto the outside of the turbine blade. A cooling-fluid film forms there and this screens the outside of the turbine blade from the hot working medium of the turbine (see DE 36 42 789 C2). Air which originates from the compressor of the gas-turbine plant or from an external source and is under positive pressure or even appropriately treated steam is known as cooling fluid.

Steam-cooling systems which first of all hold the steam in a closed cooling circuit, the steam originating from a steam circuit, vary from the technical point of view. The steam, which is heated by the convective cooling process, is fed again to the steam circuit (see EP 06 98 723 A2). Also known are open steam-cooling systems, in which the heated steam is directed via openings in the blade body onto the outside of the turbine blade. In addition, there are so-called hybrid steam-cooling systems having a closed main part and a cooling system which is open in the region of the trailing blade edge, the open cooling system being operated with steam or with air.

Compared with open steam-cooling systems and even compared with the known hybrid steam-cooling systems, closed steam-cooling systems have advantages relating to the process. The range of use of such systems is nowadays expanding, in particular on account of their higher efficiency. However, a closed steam-cooling system can be severely damaged by the penetration of foreign bodies into the cooling passage adjacent to the leading blade edge. Depending on the number and size of the holes forming in the leading blade edge during the impingement of the foreign bodies, so much cooling steam may escape that adequate blade cooling no longer takes place downstream of the point of penetration. As a result, the material overheats, for which reason serious consequential damage may occur.

SUMMARY OF THE INVENTION

Accordingly, one object of the invention, in attempting to avoid all of these disadvantages, is to provide novel turbine blades having increased functional reliability.

According to the invention, this is achieved in that, in a device according to the preamble of claim 1, the interior space of the blade body in the region of the suction-side wall, the pressure-side wall and the trailing blade edge has a closed cooling system having at least one cooling passage. On the other hand, a separate, open cooling system having at least one cooling passage and a plurality of film-cooling holes which pass through the blade body is formed in the region of the leading blade edge.

As a result of the division of the blade cooling into two separate cooling systems, only the open cooling system adjacent to the leading blade edge is affected when foreign bodies of normal size penetrate. However, the convective cooling of the main part of the blade body by means of steam remains ensured. In the region of the leading blade edge, the blade body is likewise convectively cooled and in addition film-cooled via the open cooling system.

In an especially advantageous manner, the open cooling system consists of two cooling passages arranged parallel to one another and connected to one another via a plurality of feed openings. In this design, the cooling can also be maintained downstream of a leak in the first cooling passage by the feeding of the cooling medium from the second cooling passage.

In a first development of the invention, the cooling passage adjacent to the leading blade edge is of at least approximately circular design. The film-cooling holes are arranged so as to start tangentially from this first cooling passage, whereas the feed openings start tangentially from the second cooling passage and lead likewise tangentially into the first cooling passage. A rotating movement is thereby imposed on the cooling medium in the first cooling passage. This vortex of the cooling medium provides for both improved convective cooling in the interior space and effective film cooling of the blade body.

It is especially expedient if the film-cooling holes are oriented toward the suction-side wall and at least approximately in the direction of flow of the working fluid of the gas turbine. The desired direction of flow is therefore already preset for the cooling medium issuing at high velocity from the film-cooling holes. In this way, an improved action of the cooling film spreading on the suction-side wall of the turbine blade and thus improved film cooling can be achieved.

In a second development of the invention, the closed steam-cooling system also consists of at least two cooling passages which are arranged parallel to one another and are connected to one another via connecting openings. After the penetration of foreign bodies, the cooling medium flows through the connecting openings to the corresponding points of penetration, so that the cooling sections lying downstream on the cooling side can fill again with cooling medium. In this way, the functional reliability of the turbine blades can be further increased.

Finally, depending on availability, air is used as cooling medium in the open cooling system or, as in the closed cooling system, steam is used as cooling medium.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of the moving blade of a gas turbine, wherein:

FIG. 1 shows a partial longitudinal section of a moving blade having a closed and an open cooling system;

FIG. 2 shows a cross section through FIG. 1 in plane II—II (enlarged);

FIG. 3 shows a representation similar to FIG. 1 but with two parallel cooling passages;

FIG. 4 shows a cross section through FIG. 3 in plane IV—IV (enlarged).

Only the elements essential for the understanding of the invention are shown. Elements of the gas-turbine plant which are not shown are, for example, the compressor, the combustion chamber and the guide blades of the gas turbine. The direction of flow of the working media is designated by arrows.

DESCRIPTION OF THE PREFERRED EMBODIMENTS

Referring now to the drawings, wherein like reference numerals designate identical or corresponding parts throughout the several views, the gas turbine (not shown) has several rows of moving and guide blades. One of the moving blades 1 is shown in FIG. 1. It consists of a blade root 2 and a blade body 3. The blade body 3 of the moving blade 1 has a suction-side wall 4, a pressure-side wall 5 opposite the suction-side wall 4, a leading blade edge 6 and a trailing blade edge 7. It has a hollow interior space 8, which, in the region of the suction-side wall 4, the pressure-side wall 5 and the trailing blade edge 7, accommodates a closed steam-cooling system 9 having a cooling passage 10 (FIG. 2). On the other hand, an open cooling system 11 having two cooling passages 14, 15 arranged parallel to one another is formed in the region of the leading blade edge 6. A dividing wall 16 is arranged between the closed steam-cooling system 9 and the open cooling system 11.

The first cooling passage 14 of the open cooling system 11 is adjacent to the leading blade edge 6, is of circular design, and is connected to the second cooling passage 15 via a plurality of feed openings 18 arranged in an intermediate wall 17. The first cooling passage 14 may of course also have other suitable forms, such as, for example, an approximately circular, an elliptical or a potato-shaped design (not shown). The intermediate wall 17 is connected in the region of blade root 2 to the suction-side wall 4 via a connecting piece 19, a plurality of cooling holes 20 for the local cooling of the suction-side wall 4 being arranged in the connecting piece 19.

The feed openings 18 arranged in the intermediate wall 17 tangentially adjoin the two cooling passages 14, 15. Starting from the first cooling passage 14, a film-hole row 21 having in each case a plurality of tangential film-cooling holes 22 oriented toward the suction-side wall 4 as well as approximately in the direction of flow 12 of the working fluid 13 of the gas turbine is formed in the blade body 3 in such a way as to pass through the latter. A plurality of film-hole rows 21 may also be arranged in the blade body 3, a feature which is indicated in FIG. 2 by a second film-hole row 21 shown by broken lines.

During operation of the gas turbine plant, the hot working fluid 13 originating from the combustion chamber is directed into the gas turbine and is expanded there via the moving blades 1. In the process, solid particles may penetrate into the gas turbine and collide with its components. Since the open cooling system 11 in the region of the leading blade edge 6 and thus in the direction of flow 12 of the working fluid 13 of the gas turbine is arranged furthest upstream, the particles contained in the working fluid 13 and striking the blade body 3 of the moving blade 1 can damage virtually only the open cooling system 11, while the closed cooling system 9, which is separate from the latter, is protected. For this reason, the cooling of the main part of the blade body 3 is ensured from the outset.

In the open cooling system 11, air which either originates from the compressor of the gas-turbine plant or from an external source and is under positive pressure is used as the cooling medium 23. Via a feed passage 24 arranged in the blade root 2, the air 23 is directed into the second cooling passage 15 and serves the convective cooling of the blade body 3 there. The air 23 then passes via the feed openings 18 into the first cooling passage 14, where it likewise convectively cools the blade body 3. As a result of the circular design of the first cooling passage 14 and the tangential injection of the air 23, the latter is subjected to a rotating movement, which markedly improves the cooling action. Starting from the first cooling passage 14, the air 23 passes through the likewise tangentially arranged film-cooling holes 22 onto the suction-side wall 4. There, it forms a thin cooling film, which screens the outer surface of the blade body 3 from the hot working fluid 13 of the gas turbine. Due to the orientation of the film-cooling holes 22, the air 23 is already discharged approximately in the direction of flow 12 of the working fluid 13 of the gas turbine, a factor which further improves the film cooling.

Appropriately treated steam may of course also be used as the cooling medium 23. In this case, both the closed and the open cooling system 9, 11 are operated with the same cooling medium 23, 26. Therefore no separate cooling-medium feed is necessary, so that the dividing wall between the two cooling systems 9, 11 may be shortened (not shown) in the region of the blade root 2.

The particles contained in the working fluid 13 strike the leading blade edge 6 of the moving blade 1 with high kinetic energy and may penetrate the latter. Holes 25 are thereby knocked in the blade body 3 in this region (FIG. 1, FIG. 2). The air 23 which escapes through the holes 25 is compensated for by additional feeding of air 23 from the second cooling passage 15. Any penetrating hot working fluid 13 of the gas turbine is first of all held in the center of the swirled air 23 and finally diluted with the latter, so that the cooling in the open cooling system 11 can be maintained even after the striking of particles.

That cooling medium 23 of the open cooling system 11 which has passed into the working fluid 13 of the gas turbine during the cooling action is expanded in the downstream part of the turbine blading. On the other hand, the steam used as cooling medium 26 in the closed steam-cooling system 9 is recycled and, for example, expanded (not shown) in the steam circuit of a steam turbine connected to the gas turbine.

In a second exemplary embodiment, the closed steam-cooling system 9 is designed as a serpentine cooling system. It consists of two cooling passages 27, 28 which are arranged parallel to one another and extend in the longitudinal direction of the blade from the blade root 2 up to the blade tip 29. The cooling passages 27, 28 are reoriented at the blade tip 29 in the direction of the blade root 2 of the moving blade 1 (FIG. 3). Rib walls 30 which have a plurality of connecting openings 31 are arranged between the two parallel cooling passages 27, 28 through which the steam 26 flows in the same direction. A rib wall 32 is of course also arranged between the cooling passages 28, 27 through which flow occurs in opposite direction. However, this rib wall 32 has no connecting openings 31 (FIG. 4). Outlet openings 33 for any dirt particles or other foreign bodies of the cooling medium 26 are located at the blade tip 29.

During operation of such a gas-turbine plant, holes 25 in the region of the closed steam-cooling system 9 may also be compensated for. If foreign particles penetrate in this region of the moving blade 1, the cooling medium flows out of the cooling passage 27, 28 which is not affected in each case through the connecting openings 31 to the corresponding holes 25, so that the cooling section lying downstream on the cooling side can fill again with steam 26. The process sequences relating to the open cooling system 11 are analogous to those stated with regard to the first exemplary embodiment.

The guide blades (not shown) of a gas turbine may of course be designed in a similar manner with regard to their cooling.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A turbine blade of a gas turbine, having a blade body which consists of a leading blade edge, a trailing blade edge opposite the latter, a suction-side and a pressure-side wall, and a hollow interior space, and in the hollow interior space of which a plurality of cooling passages carrying at least one cooling medium are arranged, wherein a) the interior space in the region of the suction-side wall, the pressure-side wall and the trailing blade edge has a closed steam-cooling system having at least one cooling passage, b) an open cooling system having at least one cooling passage and a plurality of film-cooling holes which pass through the blade body is formed in the region of the leading blade edge.

2. The turbine blade as claimed in claim 1, wherein the open cooling system consists of two cooling passages arranged parallel to one another and connected to one another via a plurality of feed openings.

3. The turbine blade as claimed in claim 2, wherein the film-cooling holes are arranged so as to start tangentially from the first cooling passage adjacent to the leading blade edge, and the feed openings are arranged so as to start tangentially from the second cooling passage and so as to lead, likewise tangentially, into the first cooling passage.

4. The turbine blade as claimed in claim 3, wherein the first cooling passage is of at least approximately circular design.

5. The turbine blade as claimed in claim 4, wherein the film-cooling holes are oriented toward the suction-side wall and at least approximately in the direction of flow of the working fluid.

6. The turbine blade as claimed in claim 1, wherein the closed steam-cooling system consists of at least two cooling passages which are arranged parallel to one another and are connected to one another via connecting openings.

7. The turbine blade as claimed in claim 2, wherein air is used as cooling medium in the open cooling system.

8. The turbine blade as claimed in claim 2, wherein steam is used as cooling medium in the open cooling system.

* * * * *